United States Patent [19]

Tobey et al.

[11] 4,033,254

[45] July 5, 1977

[54] METHOD AND APPARATUS FOR PRINTING ON THE SIDE OF EMPTY BOXES

[75] Inventors: Hubert Earl Tobey, Milltown; John William Hood, East Brunswick; Alphonse Michael Masiuk, Englishtown; Dee Lavern Irvin, Moonachie; George Otto Moller, Dumont, all of N.J.

[73] Assignee: International Telephone and Telegraph Corporation, Nutley, N.J.

[22] Filed: Jan. 29, 1976

[21] Appl. No.: 653,424

[52] U.S. Cl. ..... 101/44; 101/DIG. 3; 101/235; 101/426

[51] Int. Cl.[2] ..... B41F 17/24

[58] Field of Search ..... 101/DIG. 3, 35, 36, 101/37, 41, 42, 43, 44, 235, 426

[56] References Cited

UNITED STATES PATENTS

| | | | |
|---|---|---|---|
| 3,037,447 | 6/1962 | Gonzalez et al. | 101/235 X |
| 3,083,636 | 4/1963 | Carkhuff | 101/37 |
| 3,128,698 | 4/1964 | Hennequin | 101/235 |
| 3,168,863 | 2/1965 | McRae | 101/DIG. 3 |
| 3,595,164 | 7/1971 | Hovekamp | 101/37 |
| 3,735,697 | 5/1973 | Provan | 101/37 |
| 3,752,067 | 8/1973 | Gill | 101/DIG. 3 |
| 3,765,326 | 10/1973 | Hawkins | 101/44 |
| 3,837,276 | 9/1974 | Reichert | 101/DIG. 3 |
| 3,895,574 | 7/1975 | Nyborg | 101/37 |

*Primary Examiner*—Clifford D. Crowder
*Attorney, Agent, or Firm*—John T. O'Halloran; Alfred C. Hill

[57] ABSTRACT

A rotatable anvil is capable of being rotated from a rest position to engage the interior of each empty box moved on a conveyor in sequence adjacent a blank area on a selected side panel of the empty box adjacent a leading side panel perpendicular to the selected side panel to place the anvil and the empty boxes in a printing position. A printer is disposed at the printing position and adjacent the exterior of the empty boxes moved into the printing position. A control arrangement is provided to control the rotation of the anvil from the rest position to the printing position and back to the rest position and to actuate the printer when the anvil is in the printing position to print the unit price, date, total price and the like in the blank area of the empty boxes moved into the printing position.

9 Claims, 5 Drawing Figures

METHOD AND APPARATUS FOR PRINTING ON THE SIDE OF EMPTY BOXES

BACKGROUND OF THE INVENTION

This invention relates to printing apparatus and more particularly to printing apparatus for printing given information on empty boxes.

SUMMARY OF THE INVENTION

An object of the present invention is to provide a method and apparatus, in association with a conveyor conveying in sequence a plurality of boxes to print predetermined information on a selected side panel of each of the boxes.

Another object of the present invention is to provide a method and apparatus, in association with a conveyor conveying in sequence a plurality of empty boxes to a filling position, for printing a unit price, date, total price and the like in a blank, area on a selected side panel adjacent a leading side panel perpendicular to the selected side panel of each of the empty boxes.

A feature of the present invention is the provision of printing apparatus in association with a conveyor conveying in sequence a plurality of boxes to a printing position for printing on a selected side panel of each of the boxes, comprising: A rotatable anvil positioned to engage an interior portion of each of the boxes in sequence and to place the anvil and each of the boxes in the printing position; printing means disposed at the printing position and adjacent the exterior of the selected side panel; and control means coupled to the anvil and the printing means to control the rotation of the anvil into the printing position and to actuate the printing means when the anvil and each of the boxes are in the printing position to cause printing on the selected side panel.

Another feature of the present invention is the provision of a method of printing on each of a plurality of boxes being conveyed in sequence on a conveyor comprising the steps of: positioning a selected side panel of each of the boxes on said conveyor; engaging an interior portion of each of the boxes to place each of the boxes in a printing position; and actuating a printing means disposed at the printing position and adjacent the exterior of each of the selected side panels to print on each of the panels when each of the boxes is in said printing position.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
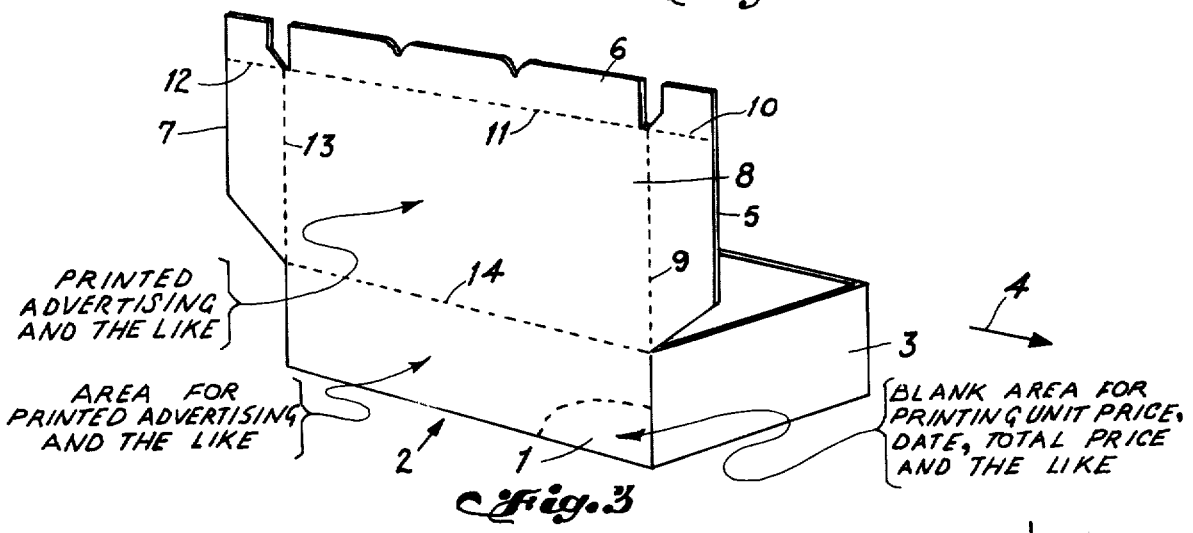
FIG. 1 is a perspective view of an example of a box to be printed in accordance with the apparatus and method of the present invention.

Referring to FIG. 1 there is illustrated therein a typical box that is to be printed by the apparatus of the present invention with the printed material including a unit price, date, total price and the like being printed in blank area 1 on a selected side panel 2 adjacent the leading side panel 3 perpendicular to said panel 2 with the leading side panel 3 being that side panel that moves along a conveyor first in the direction of arrow 4. The other areas of selected side panel 2, flaps 5, 6, 7 and top 8, include advertising or other printed material and to avoid overprinting this printed material, blank area 1 is provided. The dash lines 9, 10, 11, 12, 13 and 14 represent score lines to enable folding the top 8 and the flaps 5 – 7 along the score lines to form a cover for the box after the printing has taken place and the box has been filled. When the box is being printed in blank area 1, the top and flaps are in the position illustrated.

Figure 2:
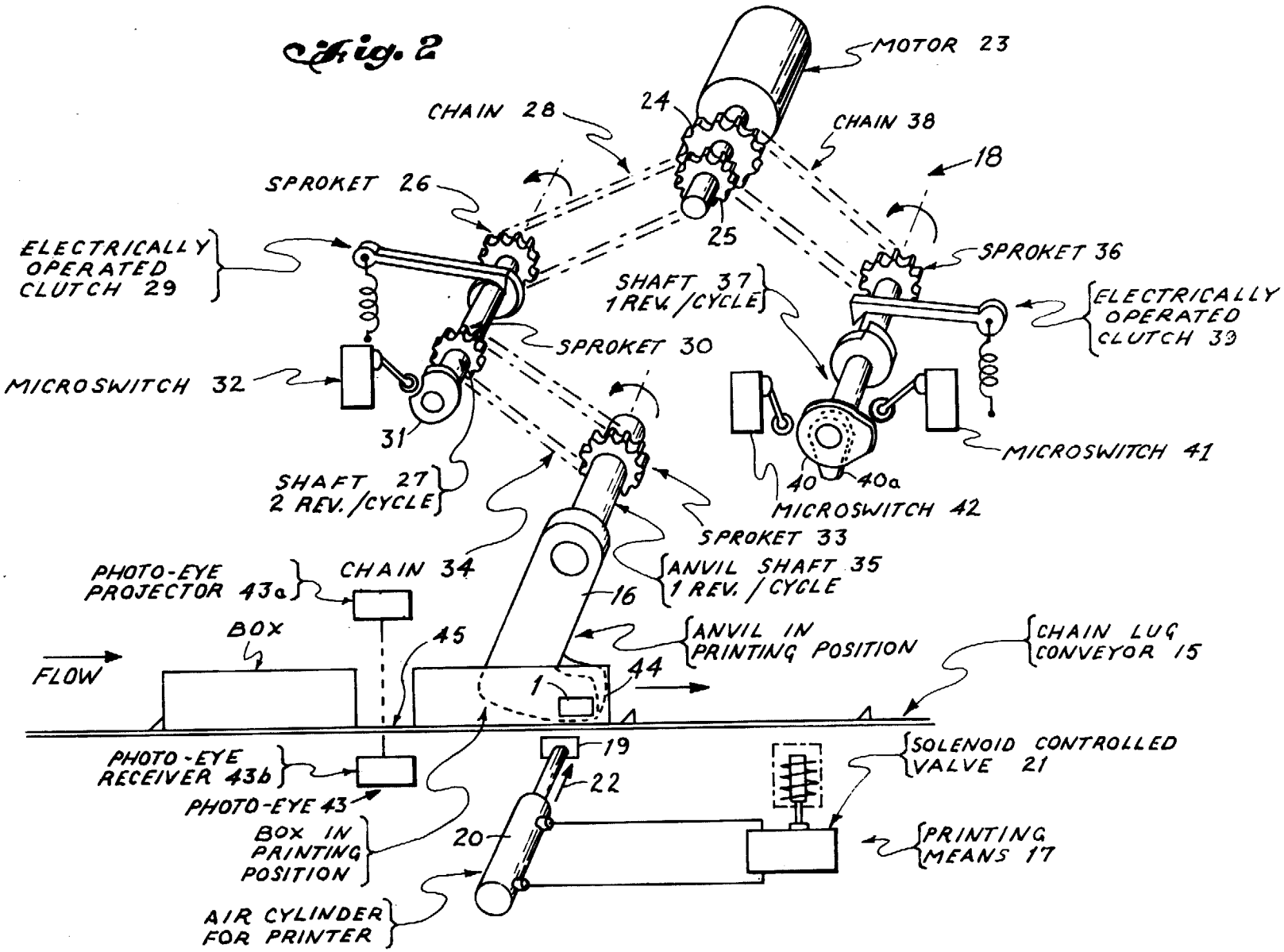
FIG. 2 is a schematic illustration of the apparatus to carry out the method in accordance with the principles of the present invention.

Referring to FIG. 2 there is illustrated schematically the apparatus for printing the unit price, date, total price and the like in blank area 1 of the box of FIG. 1. The boxes are moved in sequence to a filling position (not shown) by a chain lug conveyor 15. The apparatus in accordance with the principles of the present invention basically includes a rotatable anvil 16 which is shown in the printing position, the rest position of anvil 16 being 180° from the position illustrated, a printing means 17 and a control means 18.

Printer 17 includes an interchangeable printing head 19, an air cylinder 20 which is actuated when the solenoid controlled valve 21 is actuated to release air from the air cylinder 20 to move printing head 19 in the direction of arrow 22. Printer 17, which has been employed in the apparatus of this invention, is the Norwood Model KS-7CB imprinter available from Norwood Marking and Equipment Company. Printer head 19 is interchangeable to enable changing the unit price, the date, the total price and/or the like to adjust the printed information to account for fluctuations in the price of the product to be placed in the boxes.

Control means 18 includes motor 23 rotating a large sprocket 24 and a small sprocket 25. Sprocket 24 is interconnected with sprocket 26 to shaft 27 by a chain 28. Shaft 27 has secured thereto electrically operated clutch 29, a sprocket 30 and a cam 31 to control the operation of microswitch 32. Sprocket 30 is interconnected with sprocket 33 by chain 34 with sprocket 33 being secured to the anvil shaft 35 to control the rotation of anvil 16. The small sprocket 25 driven by motor 23 is interconnected with sprocket 36 on shaft 37 by chain 38. Shaft 37 has an electrically operated clutch 39 secured thereto, an independently adjustable cam 40 to control microswitch 41 and an independently adjustable cam 40*a* to control microswitch 42. Photo-eye 43 including photo-eye projector 43*a* and photo-eye receiver 43*b* is also part of the control means 18 and is adjacent conveyor 15 to be actuated when the leading side panel 3 of the boxes being moved by conveyor 15 break the photo-eye beam.

The sequence of operation of the apparatus of FIG. 2 will now be described. Motor 23 runs continuously with the apparatus in the "on" condition. FIG. 2 illustrates the conditions that exist at the time of printing, however, it will be used to explain a complete printing cycle. The printing cycle starts with anvil 16 in the rest position which is 180° opposite that shown in FIG. 2.

When an empty box actuates photo-eye 43, clutch 29 is energized and starts shaft 27 to rotate, which, through sprocket 30, chain 34 and sprocket 33 starts anvil 16 to rotate from the rest position in a downward direction. The toe 44 enters the interior of the box and engages the inner surface of the leading side panel 3 of the box. Since anvil 16 travels faster than conveyor 15, the toe 44 pulls the box away from lug 45 of conveyor 15. Anvil 16 now stops in the position illustrated which is the printing position and the box is printed and released before lug 45 contacts the box again. To understand the other phases of the printing cycle, we must return to shaft 27. Shaft 27 has two revolutions per printing cycle compared to one revolution for anvil 16 and one revolution for shaft 37. After shaft 27 has rotated approximately 30°, cam 31 actuates microswitch 32 which energizes clutch 39. Shaft 27 completes the revolution and is stopped by clutch 29. When clutch 39 is energized shaft 37 rotates approximately 140° and cam 40 actuates microswitch 41. The actuation of microswitch 41 opens the solenoid controlled valve 21 to enable the air supply from cylinder 20 to operate printer head 19 just after anvil 16 and the box have stopped. While printing cam 40 rotates approximately 70°. As mentioned above, shaft 27 has completed one revolution and is in a rest position. Shaft 37 is still rotating and after the printing operation, which required approximately a 70° rotation of shaft 37, shaft 37 rotates approximately another 70° and through cam **40*a* microswitch 42 is actuated and shaft 37 rotates to its rest position. When microswitch 42 is actuated, clutch 29 is energized which starts shaft 27 to rotate again to bring anvil 16 to the rest position. This completes a full printing cycle and leaves the box just printed free to be moved on by the conveyor 15 when lug 45** catches up to the box just printed.

Figure 3:
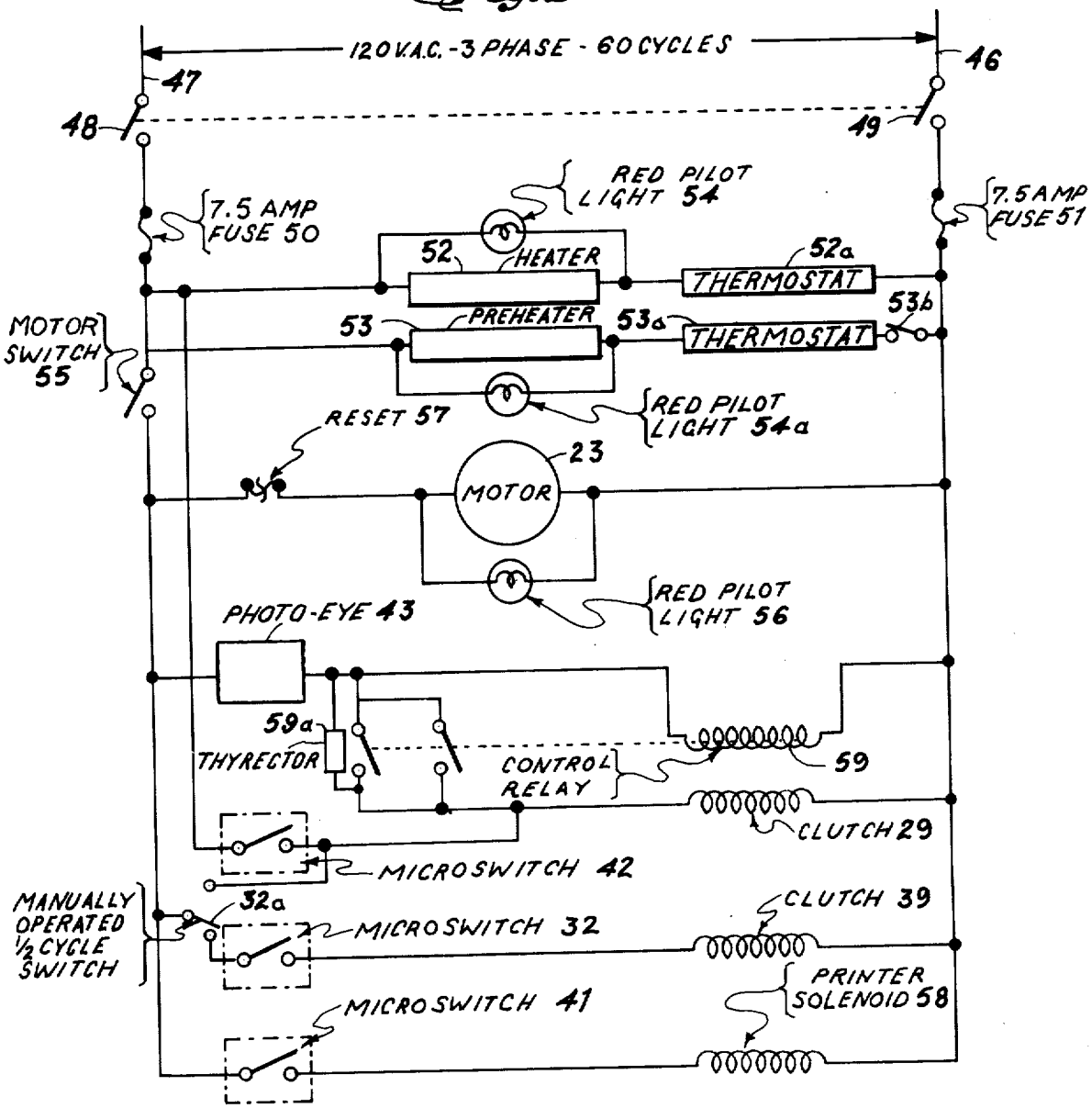
FIG. 3 is a simplified electrical circuit employed in the apparatus in accordance with the principles of the present invention.

Referring to FIG. 3 there is a schematic diagram of the electrical circuit which controls the apparatus of FIG. 2. This electrical circuit has applied between leads 46 and 47 120 volts alternating current, three phase, 60 cycles. The switches 48 and 49 mechanically interconnected are the main power switches. When switches 48 and 49 are closed, the 120 volts are applied through fuses 50 and 51 to heater 52 and hence to thermostat **52*a*. Heater 52 has 75 – 100 watts capability and is employed to heat the type block employed in printer 17. The 120 volts is also applied to a red pilot light 54. Preheater 53 with its associated red pilot light 54*a* and its associated thermostat 53*a* and switch 53*b* enables preheating and therefore availability immediately of a second type block with the next day code or different price and the like. Motor switch 55 when closed enables the operation of the control means. When switch 55 is closed, motor 23 has power supplied thereto and also to a red pilot light 56. In the circuit of motor 23 there is provided a reset 57 to enable reset of the circuit of motor 23 should this circuit become open. The remainder of the electrical circuit shows the relationship between the various microswitches 32, 41 and 42 and photo-eye 43, the clutches 29 and 39 and the printer solenoid 58. It should be noted that in the circuit of clutch 29 there is provided a control relay 59 which is energized when photo-eye 43 is activated. When control relay 59 is energized, the contacts controlled thereby are placed in a closed position so as to energize clutch 29. Clutch 29 is also controlled by microswitch 42 which when energized causes shaft 27 to rotate from its rest position so that anvil 16 can be rotated to its rest position. Thyrector 59*a*, available from automation products, is also in the circuit of clutch 29 and is employed as an arc suppressor to block current surges of the relay contacts as they open and close. Manually operated half cycle switch 32*a* is provided to ensure that anvil 16 is in its rest position at the start of a printing cycle. A hang up of anvil 16 and a printed box, a pile up of boxes at the printing position or a deformed box may cause anvil 16 to remain in the printing position rather return to the rest position and thus the control means would be out of sync. Switch 32*a*** enables correcting this condition.

Figure 4:
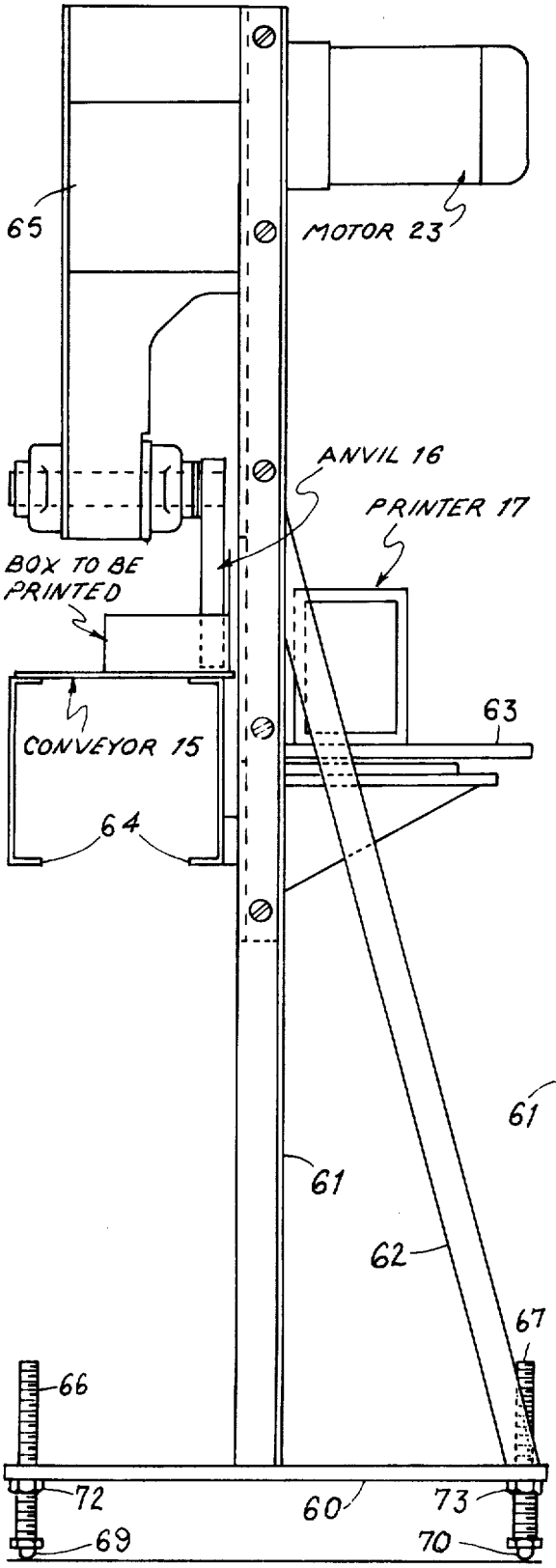
FIG. 4 is a side view of the apparatus in accordance with the principles of the present invention.
Figure 5:
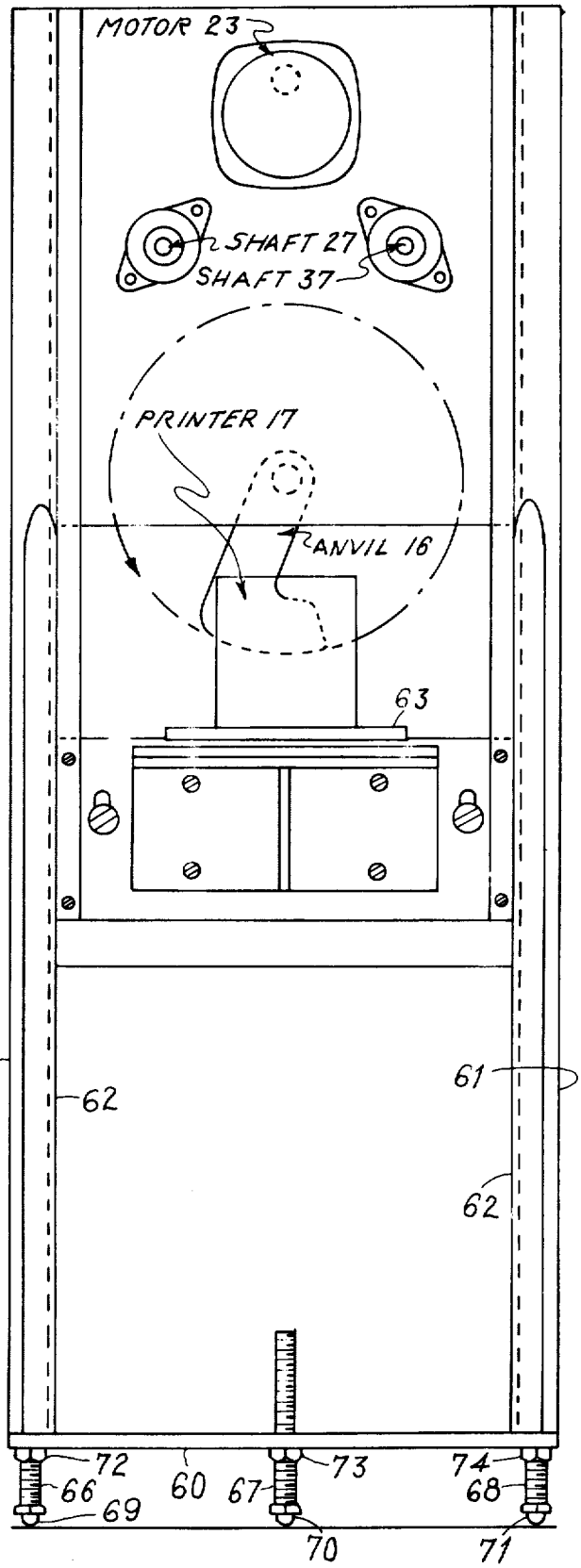
FIG. 5 is a back view of the apparatus in accordance with the principles of the present invention.

Referring to FIGS. 4 and 5, there is illustrated a side view and back view of the apparatus of the present invention. The apparatus includes a base 60 to which is secured uprights 61 which is supported by support members 62. To the back surface of uprights 61 is secured a platform 63 to support printer 17 and to the front surface of uprights 61 is attached register member 64 so that the apparatus is in a proper relationship with respect to conveyor 15 so that printer 17 can print in blank area 1 of the empty box. Uprights 61 also supports adjacent the top edge thereof motor 23 and a housing 65 containing the control means 18 with the exception of photo-eye 44 which as mentioned above is adjacent conveyor 15 and before the printing position.

Base 60 has threaded apertures therethrough to receive the threaded legs 66 – 68. Rollers or castors 69 – 71 are connected to the lower end of legs 66 – 68 which enables the apparatus to be mobile and to be capable of being moved from one conveyor to another conveyor. The threaded legs 66 – 68 in conjunction with nuts 72 – 74 enable raising and lowering the apparatus relative to conveyor 15 and also to level the apparatus.

While we have described above the principles of our invention in connection with specific apparatus it is to be clearly understood that this description is made only by way of example and not as a limitation to the scope of our invention as set forth in the objects thereof and in the accompanying claims.

We claim:

1. Printing apparatus in association with a conveyor conveying in sequence a plurality of boxes to a printing position for printing on a selected side panel of each of said boxes comprising:

a rotatable L-shaped anvil having a toe positioned to engage an interior portion of each of said boxes in sequence and to place said toe of said anvil and each of said boxes in said printing position, said toe of said anvil remaining in engagement with said interior portion of each of said boxes during said printing;

printing means disposed at said printing position and adjacent the exterior of said selected side panel; and control means coupled to said anvil and said printing means to control the rotation of said anvil into said printing position and to actuate said printing means when said toe of said anvil and each of said boxes are in said printing position to cause printing on said selected panel.

2. Printing apparatus according to claim 1, wherein said control means includes first means disposed adjacent said conveyor and spaced from said printing position to detect each of said plurality of boxes in sequence as they approach said printing position;

second means coupled to said first means and said anvil to rotate said anvil to place said anvil and each of said detected one of said plurality of boxes in said printing position in sequence; and third means coupled to said second means and said printing means to actuate said printing means when said anvil and each of said detected one of said plurality of boxes are in said printing position;

said second means rotating said anvil from said printing position to a rest position after printing each of said detected one of said plurality of boxes has been completed to await detection of a next adjacent one of said plurality of boxes to start another printing cycle.

3. Apparatus in association with a conveyor conveying in sequence a plurality of empty boxes to a filling position for printing a unit price, date, total price and the like in a blank area on a selected side panel adjacent a leading side panel perpendicular to said selected side panel of each of said empty boxes, said leading side panel being that side panel of each of said empty boxes that moves along said conveyor first comprising:

a rotatable L-shaped anvil having a toe capable of being rotated from a rest position to have said toe engage the interior of each of said empty boxes in sequence adjacent said blank area to place said toe of said anvil and each of said empty boxes in a printing position, said toe of said anvil remaining in engagement with said interior of each of said empty boxes during said printing;

printing means disposed at said printing position and adjacent the exterior of each of said empty boxes moved into said printing position; and control means coupled to said anvil and said printing means to control the rotation of said anvil from said rest position to said printing position and back to said rest position and to actuate said printing means when said anvil and each of said empty boxes are in said printing position to print said unit price, date, total price and the like in said blank area of each of said empty boxes.

4. Apparatus according to claim 3, wherein said printing means includes a printing head, an air cylinder coupled to said printing head to cause said printing head to print said unit price, date, total price and the like when air is released from said air cylinder, and a solenoid controlled valve coupled to said air cylinder, said valve being actuated to release air from said air cylinder.

5. Apparatus according to claim 3, wherein said control means includes a motor rotating a small sprocket and a large sprocket, said motor continuously running when said apparatus is "on,"

a first rotatable shaft having a first and second sprocket secured thereto, a first electrically operated clutch disposed on said first shaft, a first cam member secured to said first shaft, a first microswitch disposed to be controlled by said first cam member, a first chain interconnecting said large sprocket and said first sprocket, a second rotatable shaft having a third sprocket secured thereto and carrying said anvil, a second chain interconnecting said second sprocket and said third sprocket, a third rotatable shaft having a fourth sprocket secured thereto, a second electrically operated clutch disposed on said third shaft, a second cam member secured to said third shaft, a third cam member secured to said third shaft, a second microswitch disposed to be controlled by said second cam member, a third microswitch disposed to be controlled by said third cam member, a third chain interconnecting said small sprocket and said fourth sprocket, and a photo-eye disposed adjacent said conveyor and prior to said printing position, said photo-eye being actuated by each of said empty boxes to start a printing cycle, said photo-eye when actuated causing said first clutch to be energized and rotate said first shaft which through said second and third sprockets and said second chain to rotate said anvil from said rest position toward said printing position, said first microswitch being actuated shortly after said first shaft starts to rotate to energize said second clutch and rotate said third shaft, said second microswitch being actuated by said second cam member when said anvil is in said printing position, said second microswitch actuating said printing means, said third microswitch being actuated by said third cam member after printing has been accomplished to again energize said first clutch to rotate said first shaft and through said second and third sprockets and said second chain to return said anvil from said printing position to said rest position.

6. Apparatus according to claim 5, wherein said printing means includes a printing head, an air cylinder coupled to said printing head to cause said printing head to print said unit price, date, total price and the like when air is released from said air cylinder, and a solenoid controlled valve coupled to said second microswitch to be actuated by said second microswitch to release air from said air cylinder.

7. Apparatus comprising in combination:

a conveyor conveying in sequence a plurality of boxes for printing on a selected side panel;

means for detecting the leading edge of each of said boxes on said conveyor;

a rotatable L-shaped anvil having a toe, said anvil being responsive to said detecting means to have said toe engage an interior portion of each of said boxes in sequence adjacent said panel to place said toe of said anvil and each of said boxes in a printing position, said toe of said anvil remaining in engagement with said interior portion of each of said boxes during said printing;

printing means disposed at said printing position and adjacent the exterior of said panel, said printing means positioned and actuated to print on said side panel when each of said boxes and said toe of said anvil are moved into said printing position; and means on said conveyor to convey each of said boxes out of the printing position in sequence upon completion of printing said side panel of each of said plurality of boxes.

8. A method of printing on each of a plurality of boxes being conveyed in sequence on a conveyor comprising the step of:

positioning a selected side panel of each of said boxes on said conveyor;

engaging an interior portion of each of said boxes by a toe of a rotatable L-shaped anvil to place said toe of said anvil and each of said boxes in a printing position, said toe of said anvil remaining in engagement with said interior portion of each of said boxes during printing; and actuating a printing means disposed at said printing position and adjacent the exterior of each of said selected side panels to print on each of said panels when each of said boxes and said toe of said anvil are in said printing position.

9. A method of printing a unit price, date, total price and the like on each of a plurality of empty boxes being conveyed in sequence on a conveyor comprising the steps of:

providing a blank area on a selected side panel of each of said empty boxes adjacent a leading side panel perpendicular to said selected side panel, said leading side panel being that side panel of each of said empty boxes that moves along said conveyor first;

rotating an L-shaped anvil to have a toe of said anvil engage the interior of each of said empty boxes adjacent said blank area to place said toe of said anvil and each of said empty boxes in a printing position, said toe of said anvil remaining in engagement with said interior of each of said empty boxes during said printing; and actuating a printing means disposed at said printing position and adjacent the exterior of each of said empty boxes moved into said printing position to print said unit price, date, total price and the like in said blank area of each of said empty boxes when said empty boxes and said toe of said anvil are moved into said printing position.

* * * * *